US005740756A

United States Patent [19]

Ord

[11] Patent Number: 5,740,756

[45] Date of Patent: Apr. 21, 1998

[54] INFLATABLE FLAG AND BANNER

[76] Inventor: John R. Ord, 10110 Vestal Ct., Coral Springs, Fla. 33071

[21] Appl. No.: 743,319

[22] Filed: Nov. 5, 1996

[51] Int. Cl.[6] ..... G09F 17/00

[52] U.S. Cl. ..... 116/173; 40/800; 446/220

[58] Field of Search ..... 116/173, 210, 116/DIG. 8, DIG. 9; 40/212, 214, 800; 2/115, 244, DIG. 3; 5/417, 419, 420, 485, 502; 446/220–226

[56] References Cited

U.S. PATENT DOCUMENTS

| | | | |
|---|---|---|---|
| 1,642,022 | 9/1927 | Groh | 116/173 |
| 1,858,460 | 5/1932 | Ranseen | 446/223 |
| 2,515,804 | 7/1950 | Shufer | 446/226 |
| 3,149,352 | 9/1964 | Christiansen | 116/173 |
| 3,665,518 | 5/1972 | Leadford | 2/87 |
| 5,045,011 | 9/1991 | Lovik | 446/225 |
| 5,079,778 | 1/1992 | Sloot | 446/220 |
| 5,251,337 | 10/1993 | Sloot | 2/115 |
| 5,454,125 | 10/1995 | Ratkowski | 5/417 |

FOREIGN PATENT DOCUMENTS

| | | | |
|---|---|---|---|
| 155887 | 9/1903 | Germany | 446/220 |

*Primary Examiner*—William A. Cuchlinski, Jr.
*Assistant Examiner*—Andrew Hirshfeld
*Attorney, Agent, or Firm*—Malin, Haley, DiMaggio & Crosby

[57] ABSTRACT

A flag or banner is provided that has a balloon-like inflatable portion that can be made any shape or size to resemble a logo, basketball, football, decorative or ornamental shape or symbol, or any other symbol or three dimensional representation desired. The flag surface can have any desired accompanying indicia. The flag portion and inflatable portion can be integrally made as one piece. Alternately, the flag can have an opening sized and shaped to receive the inflatable portion. The inflatable portion can include an area of excess material for attaching to the flag portion adjacent the inner perimeter of the sized and shaped opening. The attachment of the inflatable portion to the flag portion can be by spot welding, and permits the flag portion to appear to emanate from the inflatable portion when the inflatable portion is fully inflated.

4 Claims, 2 Drawing Sheets

INFLATABLE FLAG AND BANNER

BACKGROUND OF THE INVENTION

1. Field of the Invention

This invention relates to decorative and warning flags and banners, and more particularly to flags and banners that include an inflatable portion to display three dimensional symbols, shapes, or messages for decorative or safety warning purposes.

2. Description of Related Art

Flags and banners displaying sports teams, schools, colleges, clubs, and business names, trademarks, symbols, and other readily recognizable messages are well know in the art. In addition, numerous decorative flags are presently being used by homeowners for general and/or holiday decoration. Similar flags and banners displaying safety warning messages are also known in the art. However, until now, prior art flags and banners have been two dimensional, essentially flat or planar, displays.

Three dimensional displays, such as balloons, containing various messages and/or being of various shapes are also known in the art. What is not known are flags and banners that contain inflatable areas that provide three dimensional relief to, what until now, has been two dimensional flags and banners.

SUMMARY OF THE INVENTION

The present invention is in essence a flag or banner that has an inflatable portion that can be made any shape or size to resemble a logo, basketball, football, decorative or ornamental shape or design such as a heart for Valentine's day, or any other symbol or three dimensional representation desired.

The flag is made of any suitable material, such as vinyl, and in one embodiment, will have an open area in the shape and size of the desired inflatable portion. The desired shape and size opening can be die cut into the flag. An essentially air tight balloon-like inflatable portion, in matching shape and size to the flag opening, can be connected to the flag's open area.

The balloon-like inflatable portion can be made of any suitable material, such as vinyl. The balloon-like inflatable portion can have an excess of material around its perimeter to facilitate the balloon-like inflatable portion's attachment to the flag. To attach the balloon-like portion to the flag opening, the excess material at the perimeter of the balloon-like inflatable portion can be carefully spot welded or heat sealed to the flag's material adjacent the opening. The positioning and attachment of the balloon-like portion's excess material is accomplished in such a manner that, upon inflation of the balloon-like portion, the flag material does not pucker, but lies flat around the inflated portion. In this manner, the flag appears to emanate from the balloon-like portion when the balloon-like portion is inflated, thereby providing the appearance of a flag with a three dimensional area.

The inflated three dimensional area can be any desired symbol. For example, a basketball team, or a fan., may utilize the present invention to have a flag with the appearance of a fully inflated basketball at its center along with the team's name on the flat portion of the flag over or adjacent the inflated basketball. A football, baseball, soccer, or even hockey team, or fans, may do the same with the appropriate ball, or puck. Likewise, any purely decorative shape or symbol can be utilized.

In accordance with these and other objects which will become apparent hereinafter, the instant invention will now be described with particular reference to the accompanying drawings.

DESCRIPTION OF THE PREFERRED EMBODIMENTS

Figures 1, 2:
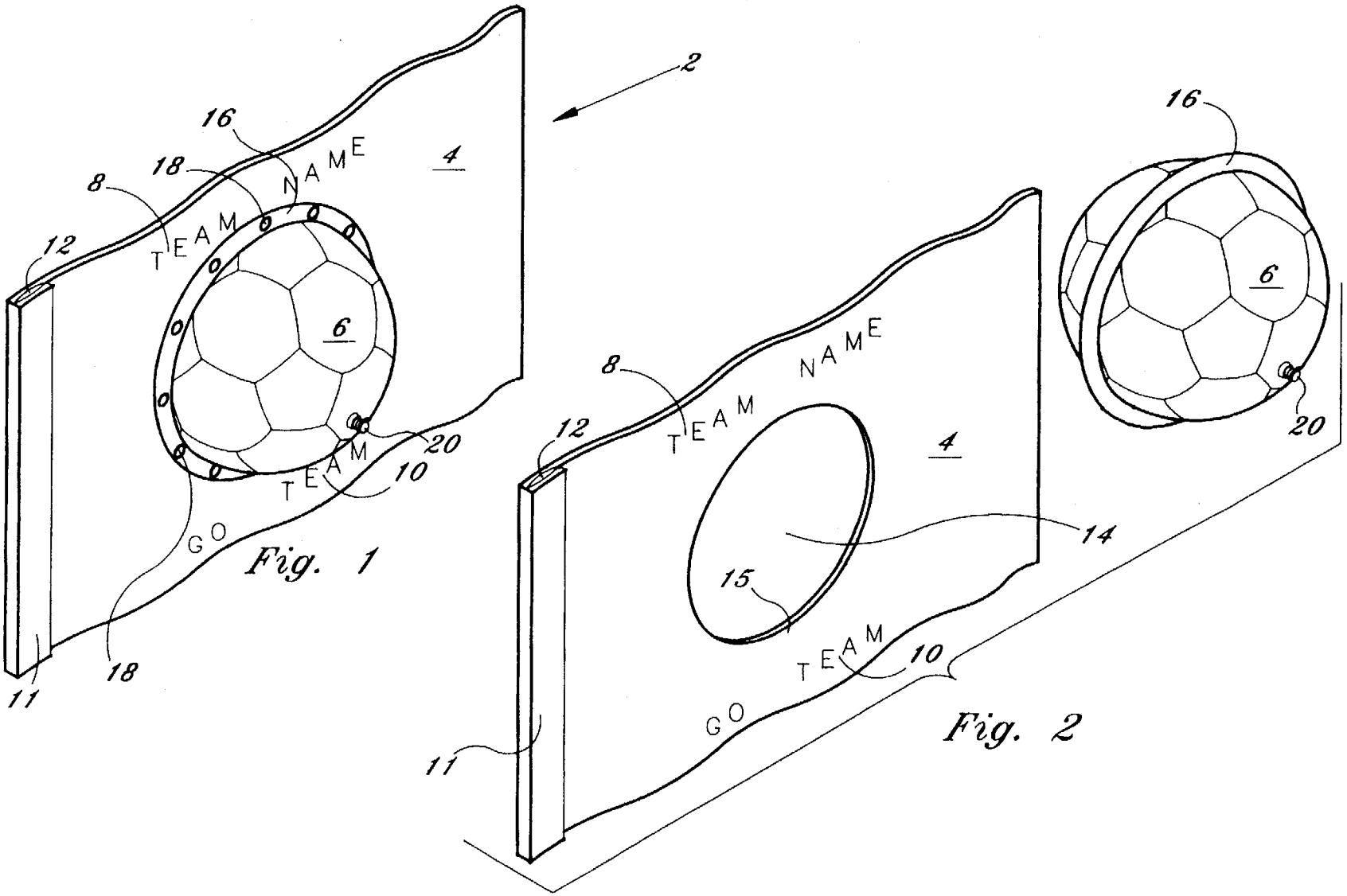
FIG. 1 is a perspective view of one embodiment of the present invention.
FIG. 2 is an exploded view of FIG. 1.
Figures 3, 4, 5:
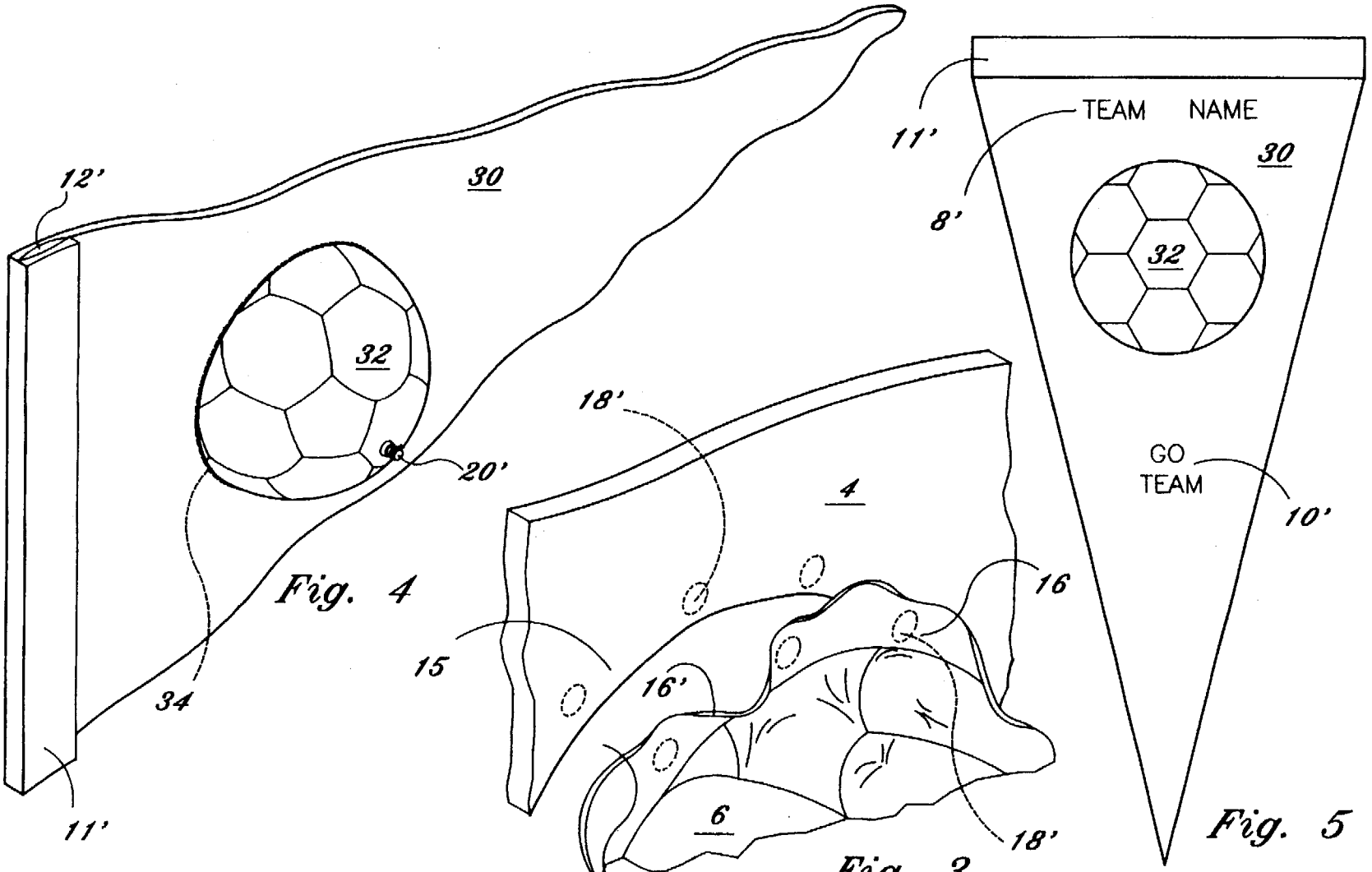
FIG. 3 is a partial enlarged view of the attachment of the inflatable portion to the flag portion of the present invention.
FIG. 4 is a perspective view of an alternate embodiment of the present invention.
FIG. 5 is a front elevational view of that shown in FIG. 4.

Referring now to FIGS. 1 and 2, by way of example only, the present invention is described with an inflatable portion that appears as a soccer ball. The present invention is not limited to this embodiment, as the inflatable portion can be made to resemble almost any three dimensional shape such as basketballs, baseballs, footballs, other emblems, logos, trademarks, decorative items, and other recognizable shapes. The flag is shown essentially rectangular, but can be other shapes as well, such as triangular as shown in FIGS. 4 and 5. The indicia can be any desired message suitable to accompany the preselected inflated portion. This includes company names associated with a trademark. For example, an inflated portion resembling a soft drink bottle of recognizable shape with the name of the product printed on the flag or banner.

The present invention, shown generally as 2 in FIG. 1, includes two major elements, flag portion 4, and an essentially air tight balloon-like inflatable portion 6. Flag portion 4 can be made of any suitable material, such as vinyl. Flag portion 4 can have any desired accompanying indicia on any suitable surface thereof, such as at 8 and 10. Flag portion 4 can have a suitable attachment location, such as 11, for attachment to a mounting device such as a flag pole (not shown). Attachment location 11 can be made in any suitable manner such as by folding an edge of flag portion 4 back onto itself and attaching the edge to flag portion 4 in any suitable manner, such as welding, to form a pocket 12.

Flag portion 4 can be hung horizontally as shown in FIGS. 1 and 2, or in an alternate embodiment, can be hung in a vertical manner, as shown in FIG. 5. If hung vertically, indicia 8' and 10' would be oriented for reading in the vertical position as shown in FIG. 5.

Flag portion 4 has an open area or aperture shown as 14 in FIG. 2. Open area 14, can be provided in flag portion 4 by any suitable manner such as die cut, and is sized to receive inflatable portion 6. Open area 14, as shown in FIG. 2, is bounded by flag portion 4. In an alternate embodiment (not shown), open area 14 can be positioned at an edge of flag portion 4 such that when inflatable portion 6 is received within open area 14, inflatable portion 6 will form a portion of the perimeter of flag 2.

inflatable portion 6 can have material 16 to aid in attachment of inflatable portion 6 to flag portion 4. In one embodiment, inflatable portion 6 can be two hemispheres welded together, and material 16 can be the welded seam. Material 16 is attached to flag portion 4 adjacent the perimeter of open area 14, shown as 15 in FIG. 2, by any suitable means, such as spot welds 18. The combination of the sizing and positioning of open area 14 and mating inflatable portion 6; the amount of material 16; and the connection of material 16 to adjacent perimeter 15 by a plurality of spot welds 18, is critical to insure that flag material 4 will not pucker but will lie flat and appear to emanate from inflatable portion 6, when inflatable portion 6 is fully inflated.

FIG. 3 shows inflatable portion 6, in a deflated state, being properly positioned in open area 14 of flag portion 4 for spot welding material 16 to perimeter 15 at a plurality of positions 18'. As can be seen in FIG. 3, when inflatable portion 6 is in the deflated state, material 16 has, between spot weld positions 18', excess material 16'. The amount of excess material 16' is critical to the proper fit of inflatable portion 6 to flag portion 4. When flag portion 6 is inflated, excess material 16' is pulled tight, but not too tight so as to the shape of the inflatable portion 6 or flag portion 4. The overall appearance of the inflatable flag 2 is that the flag portion 4 emanates from the inflatable portion 6, as best seen in FIG. 1. If the amount of excess material 16' is selected to be too little or too much, the proper appearance cannot be achieved upon full inflation of inflatable portion 6.

inflatable portion 6 can have manual inflator tube 20 for inflation and deflation.

In an alternate embodiment shown in FIGS. 4 and 5, the inflatable portion and the flag portion can be made as one piece, such that flag portion 30 will have an integral inflatable portion 32. In this embodiment, a weld 34 can follow the perimeter of inflatable portion 32 to make inflatable portion 32 essentially air tight. FIGS. 4 and 5 also show an alternate shape and vertical hanging orientation for flag portion 30. Similar elements to the embodiment shown in FIGS. 1–3 are given the same reference number in FIGS. 4 and 5 with the addition of a prime(').

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An inflatable flag comprising:

an essentially planar flexible member having a perimeter and an essentially air tight inflatable portion of a preselected size, shape, and appearance, located at least partially within said perimeter;

said essentially planar flexible member includes an aperture sized and shaped to receive said essentially air tight inflatable portion;

said essentially air tight inflatable portion includes an attachment perimeter area comprised of excess material for attachment adjacent said aperture, and means attaching said perimeter area to said essentially planar flexible member adjacent said aperture, wherein opposing sides of said essentially air tight inflatable portion extends outward from said essentially planar flexible member when said essentially air tight inflatable portion is fully inflated.

2. The inflatable flag as claimed in claim 1 wherein:

said essentially planar flexible member and said essentially air tight inflatable portion are made of vinyl; and said means for attachment is a plurality of spot welds.

3. The inflatable flag as claimed in claim 1 wherein:

said essentially planar flexible member includes preselected indicia.

4. The inflatable flag as claimed in claim 1 wherein:

said essentially planar flexible member includes means for hanging.

* * * * *